US006827912B2

(12) United States Patent
Schingnitz et al.

(10) Patent No.: US 6,827,912 B2
(45) Date of Patent: Dec. 7, 2004

(54) GASIFICATION REACTOR VESSEL

(75) Inventors: Manfred Schingnitz, Freiberg (DE); Christian Reuther, Freiberg (DE); Dietmar Degenkolb, Freiberg (DE)

(73) Assignee: Noell-KRC Energie-und Umwelttechnik GmbH, Schkeuditz (DE)

( * ) Notice: Subject to any disclaimer, the term of this patent is extended or adjusted under 35 U.S.C. 154(b) by 400 days.

(21) Appl. No.: 09/726,826

(22) Filed: Nov. 30, 2000

(65) Prior Publication Data

US 2001/0020346 A1 Sep. 13, 2001

(30) Foreign Application Priority Data

Nov. 30, 1999 (DE) ..... 199 57 696

(51) Int. Cl.[7] ..... F28D 21/00

(52) U.S. Cl. ..... 422/198; 48/61; 48/62 R; 48/77; 48/67; 48/198 R; 48/209; 48/210; 48/197 FM; 165/169; 165/189; 422/164; 422/184.1; 422/185; 422/202; 422/205; 422/240; 422/241

(58) Field of Search ..... 48/61, 62 R, 77, 48/67, 197 R, 209, 210, 197 FM; 165/169, 189; 422/164, 184.1, 185, 198, 202, 205, 240, 241

(56) References Cited

U.S. PATENT DOCUMENTS 1,921,806 A * 8/1933 Carlson ..... 165/136
4,129,422 A * 12/1978 Wood ..... 48/62 R
4,685,404 A * 8/1987 Sheppard et al. ..... 110/265
5,347,068 A 9/1994 Rabe et al.
5,449,854 A 9/1995 Yap
5,457,250 A 10/1995 Gerhardus et al.

FOREIGN PATENT DOCUMENTS

| | | | |
|---|---|---|---|
| DE | 226 588 A1 | | 8/1985 |
| DE | 3523610 A | * | 3/1986 |
| DE | 41 09 231 | | 9/1992 |
| DE | 44 46 803 | | 6/1996 |
| DE | 197 18 131 | | 11/1998 |
| DE | 198 29 385 | | 10/1999 |
| GB | 2 344 350 | | 6/2000 |

* cited by examiner

*Primary Examiner*—Jerry D. Johnson
*Assistant Examiner*—Basia Ridley
(74) *Attorney, Agent, or Firm*—Cohen, Pontani, Lieberman & Pavane

(57) ABSTRACT

The invention relates to a reactor vessel and method for the gasification of carbon-containing fuel, residual and waste materials using an oxygen-containing oxidizing agent and in a reaction chamber which is designed as an entrained-bed reactor, at pressures between ambient pressure and 80 bar, preferably between ambient pressure and 30 bar, the contour of the reaction chamber being delimited by a cooling system, and the pressure in the cooling system always being held at a higher level than the pressure in the reaction chamber, and the cooling system withstanding the maximum possible pressure difference with respect to the reaction chamber, which has been depressurized to atmospheric pressure, which reactor vessel is distinguished by the fact that cooling channels are formed by webs which are in contact both with a refractory protective layer and with the pressure shell.

17 Claims, 2 Drawing Sheets

GASIFICATION REACTOR VESSEL

BACKGROUND OF THE INVENTION

1. Field of the Invention

The present invention relates to a pressure vessel wherein the gasification of fuel, residual and waste materials can be carried out in an entrained-bed type gasification reaction.

2. Description of the Related Art

Fuel, residual and waste materials are to be understood as meaning those with or without an ash content, such as brown or hard coals and their cokes, water/coal suspensions, but also oils, tars and slurries, as well as residues or wastes from chemical and wood pulping processes from the papermaking and pulp industry, such as for example black liquor from the Kraft process, as well as solid and liquid fractions from the waste management and recycling industry, such as used oils, PCB-containing oils, plastic and domestic refuse fractions or their processing products, and residual and waste materials from the chemical industry, such as for example nitrogen- and halogen-containing hydrocarbons or alkali metal salts of organic acids.

The autothermal entrained-bed gasification of solid, liquid and gaseous fuel materials has been known for many years in the field of gas generation. The ratio of fuel material to oxygen-containing gasification agents is selected in such a way that, for reasons of quality of the synthesis gas, higher carbon compounds are cleaved completely to form synthesis-gas components, such as CO and $H_2$, and the inorganic constituents are discharged in the form of molten liquid slag (J. Carl, P. Fritz, NOELL-KONVERSIONSVERFAHREN [NOELL CONVERSION PROCESS], EF-Verlag für Energie- und Umwelttechnik GmbH 1996, p. 33 and p. 73).

Using various systems which have gained acceptance in the prior art, gasification gas and the molten liquid inorganic fraction, e.g. slag, can be discharged from the reaction chamber of the gasification appliance separately or together (DE 19718131.7).

Both systems which are provided with a refractory lining and cooled systems have been introduced for internally delimiting the contour of the reaction chamber of the gasification system (DE 4446803 A1).

Gasification systems which are provided with a refractory lining have the advantage of low heat losses and therefore offer an energy-efficient conversion of the fuel materials supplied. However, they can only be used for ash-free fuel materials, since the liquid slag which flows off the inner surface of the reaction chamber during the entrained-bed gasification dissolves the refractory lining and therefore only allows very limited operating times to be achieved before an expensive refit is required.

In order to eliminate this drawback which is encountered with ash-containing fuel materials, cooled systems working on the principle of a diaphragm wall have therefore been provided. The cooling initially results in the formation of a solid layer of slag on the surface facing the reaction chamber, the thickness of which layer increases until the further slag ejected from the gasification chamber runs down this wall in liquid form and flows out of the reaction chamber, for example together with the gasification gas. Such systems are extremely robust and guarantee long operating times. A significant drawback of such systems consists in the fact that up to approx. 5% of the energy introduced is transferred to the cooled screen.

Various fuel and waste materials, such as for example heavy-metal- or light-ash-containing oils, tars or tar-oil solid slurries contain too little ash to form a sufficiently protective layer of slag with cooled reactor walls, resulting in additional energy losses, yet on the other hand the ash content is too high to prevent the refractory layer from melting away or being dissolved if reactors with a refractory lining were to be used and to allow sufficiently long operating times to be achieved before a refit is required.

A further drawback is the complicated structure of the reactor wall, which may lead to considerable problems during production and in operation. For example, the reactor wall of the entrained-bed gasifier shown in J. Carl, P. Fritz: NOELL-KONVERSIONSVERFAHREN [NOELL CONVERSION PROCESS], EF-Verlag für Energie- und Umwelttechnik GmbH, Berlin 1996, p. 33 and p. 73 comprises an unpressurized water shell, the pressure shell, which is protected against corrosion inside with a tar/epoxy resin mixture and is lined with lightweight refractory concrete, and the cooling screen which, in the same way as a diaphragm wall which is conventionally used in the construction of boilers, comprises cooling tubes which are welded together in a gas tight manner, through which water flows, which are pinned and which are lined with a thin layer of SiC. Between the cooling screen and the pressure shell, which is lined with refractory concrete, there is a cooling-screen gap which has to be purged with a dry oxygen-free gas in order to avoid backflows and condensate formation.

To eliminate the above drawbacks, DE 198 29 385 C1 has disclosed an appliance in which a cooling gap was arranged inside the pressure shell of the gasification reactor, which gap is delimited by a cooled wall provided with ceramic material or a layer of slag in the direction toward the reaction chamber. This appliance has the advantage of representing a simple technical solution with regard to the reactor design. The drawback is that only limited pressure differences between the reaction chamber and the cooling gap are possible, leading to a considerable outlay on control and safety engineering. For example, in the event of pressure fluctuations in the reaction chamber or during start-up and run-down processes, the pressure in the cooling gap has to be constantly adapted to the pressure in the reaction chamber. This may cause problems in the event of rapid depressurization of the reaction chamber for safety engineering reasons, since the pressure in the cooling gap cannot be adapted as quickly, and this may lead to mechanical destruction of the cooling shell. DD 226 588 A1 has disclosed a pinned screen for heating installations in which the pins are designed as spacers between pressure shell or pressure shell and inner skin. However, this screen cannot be used to good effect if the ash contents in the fuel and waste materials differ.

SUMMARY OF THE INVENTION

Working on the basis of this prior art, the object of the invention is to provide an appliance which, while being simple and reliable to operate, is able to cope with a very wide range of ash contents in the fuel and waste materials and in which the pressure in the cooling gap or cooling system does not have to be constantly adapted to the pressure in the reaction chamber.

Another object of the invention is to provide a gasification reactor vessel with a cooling system for cooling the reactor vessel and an inwardly adjacent protective refractory layer with coolant supplied at a higher pressure than a pressure in the gasification chamber without imposing an undesirable or potentially damaging force of the coolant pressure on the refractory layer. A method for cooling the refractory layer and reactor vessel also provided.

The gasification reactor vessel for the gasification of carbon-containing fuel, residual and waste materials using an oxygen-containing oxidizing agent and in a gasification chamber which is designed as an entrained-bed reactor, at pressures between ambient pressure and 80 bar, preferably between ambient pressure and 30 bar, in which the contour of the reaction chamber is delimited by a cooling system, and the pressure in the cooling system is always at a higher level than the pressure in the reaction chamber, is distinguished by the fact that the cooling channels are formed by webs which are in contact both with a refractory protective layer and with a pressure shell.

As a result, the cooling system withstands and is unaffected by the maximum possible pressure difference that can exist between the reaction chamber and atmospheric pressure.

The cross section of the cooling channels is selected in such a way that pressure fluctuations in the reaction chamber can be absorbed without having to readjust the cooling system. The cross section of the cooling channels may be semicircular, oval or polygonal. The exemplary embodiment has semicircular channels.

The appliance is also distinguished by the fact that, from the outside inward, its structure is as follows: pressure shell, cooling channels, refractory protective layer and caked slag or refractory lining.

An advantage of the invention is that the pressure and temperature in the cooling channels can be selected in such a way that the cooling channels are operated above or below the coolant boiling point.

Depending on the operating conditions, the materials used for the cooling channels may be heat-resistant carbon steels (e.g. 16 Mo3) or corrosion-resistant steels.

Furthermore, it is advantageous for the cooling channels to comprise webs which are welded onto the pressure shell and are closed off by semicircular or arced segments.

Furthermore, it is essential to the invention that the refractory protective layer be attached by spread wall ties or pin-like wall ties which are welded onto the semicircular or arced segments.

The appliance according to the invention is suitable for the gasification of fuel, waste and residual materials with a very wide range of ash contents, and for the combined gasification of hydrocarbon-containing gases, liquids and solids.

According to the invention, the contour of the reaction chamber for the gasification process is delimited by a refractory lining or by a layer of solidified slag. If the reaction chamber is lined with refractory material, intensive cooling protects this material or causes liquid slag to solidify, so that a thermally insulating layer is formed. The cooling is provided by water-cooled cooling channels, it being possible to set operating conditions above or below the boiling point.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
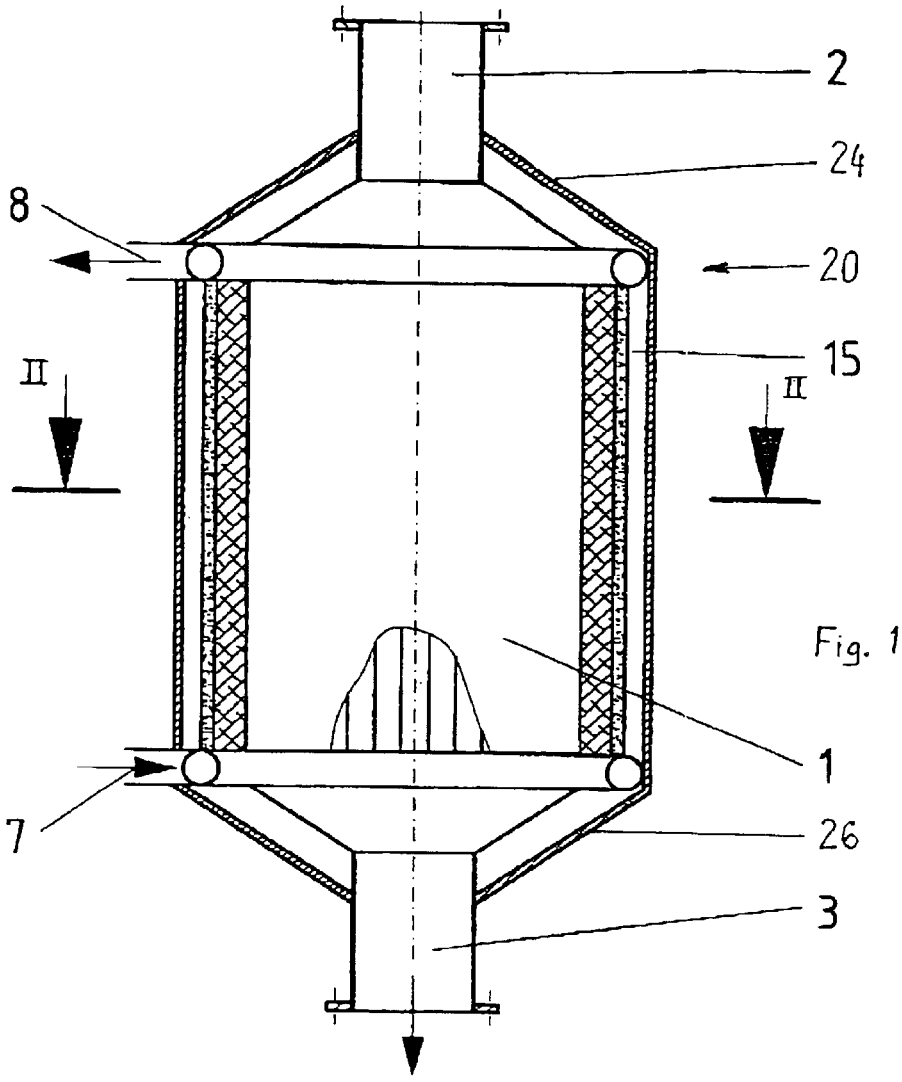
FIG. 1 is a longitudinal section through the reactor vessel with a portion of the slag or brickwork lining broken away.
Figure 2:
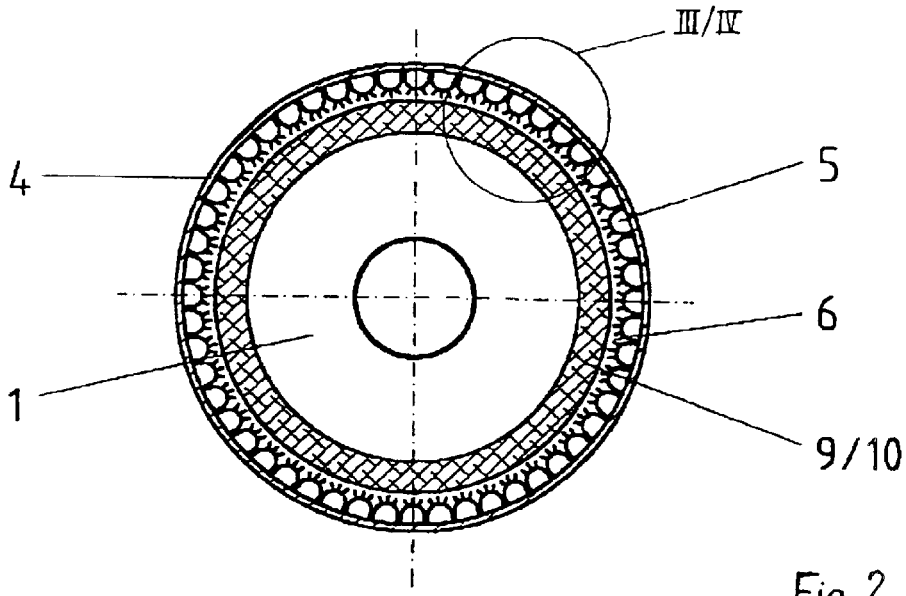
FIG. 2 is transverse section view of the reactor vessel.

FIGS. 1 and 2 show a longitudinal section and a cross section through the gasification reactor. The conversion of the fuel, residual and waste materials using the oxygencontaining oxidizing agent to form a crude gas containing high levels of $H_2$ and CO takes place in the reaction chamber 1.

Figure 3:
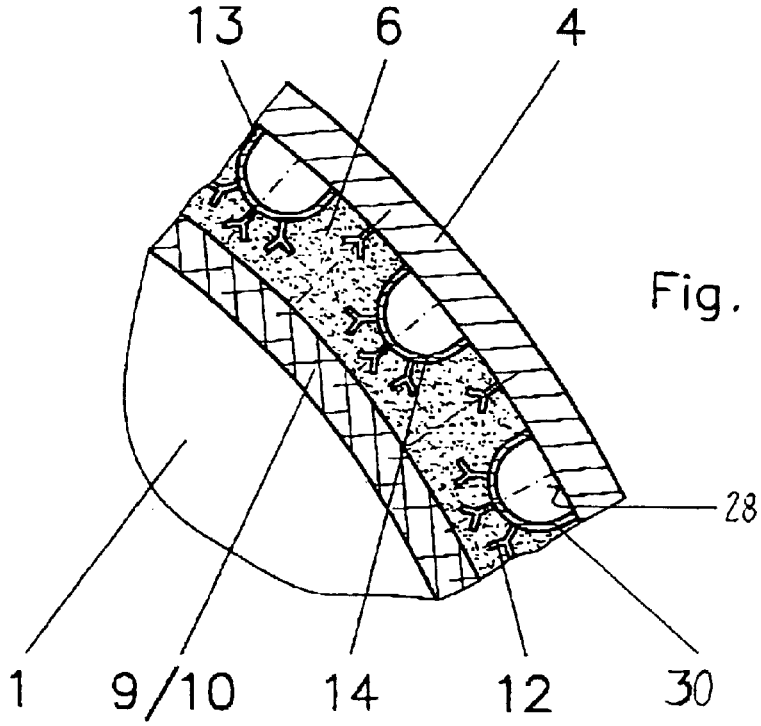
FIG. 3 is an enlarged sectional view of an embodiment of the reactor vessel taken from the circled area III/IV in FIG. 2.
Figure 4:
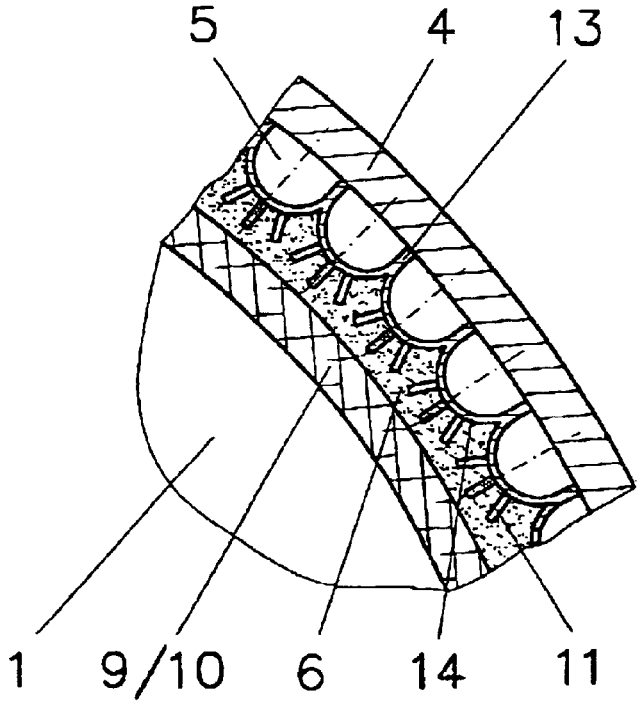
FIG. 4 is a view similar to FIG. 3 of an another embodiment of the reactor vessel.

Referring to FIG. 1, the gasification reactor vessel 20 includes a cylindrical pressure shell 4 and shell ends 24, 26 at opposite ends of shell 20. The elongated encircling body wall of the shell has an inner side 28 (FIG. 3) around which is arrayed a plurality of channel members 30 which extend lengthwise in the shell with the channel open side facing the innerside 28. The channel members 30 are fixedly connected as by watertight and gastight welding connections to the inner side 28 so that an enclosed conduit space is defined in which water coolant can flow. The channel members 30 can be circularly arrayed inside the shell at spaced locations as shown in FIG. 3 or they may be in side-by-side longitudinal abutment one with another as shown in FIG. 4. If the channel members 30 are arranged as in FIG. 4, they can be welded not only to the shell inner side 28 but also to on another, e.g., by welding a web of each to a web of an adjacent channel.

The gasification media are supplied by means of special burners which are attached to the burner flange 2, the burner flange being mounted on shell end 24. The crude gasification gas, if appropriate together with liquid slag, leaves the reaction chamber 1 via the fitting 3 in shell end 26, which fitting is provided with a special appliance, and the gas passes to further gas treatment steps. The gasification reactor is surrounded by the pressure shell 4, which withstands the difference in pressure between the reactor interior and the outside atmosphere. For thermal protection of the reactor vessel, there is a cooling system 15 which comprises cooling channels or conduits 5 defined by channel members 30. The conduits are supplied with water coolant and can be operated above or below the boiling point, which depends on the overall pressure. To prevent gasification gas from entering the cooling system 15 in the event of damage, the pressure of this system is always held at a higher level than the pressure in the reaction chamber 1. The relatively small dimensions of the cooling channels 5 allow their pressure to be maintained even when the reaction chamber 1 is depressurized to atmospheric pressure. Likewise, in the event of fluctuations in the pressure in the reaction chamber 1, the pressure in the cooling channels 5 can remain constant, provided the condition that it always be higher than the pressure in the reaction chamber 1 is satisfied. In the direction of the reaction chamber 1, the cooling channels 5 are delimited by a refractory protective layer 6, which is applied as ramming compound and is held by pins or anchors, as illustrated, by way of example, as 11 in FIG. 4 or 12 in FIG. 3. The water coolant which is required in the cooling system 15 is supplied via supply piping 7 which is connected to common ends of the channel members 30, and is discharged as hot water or steam via outlet piping 8 which is connected to opposite ends of the channel members.

If ash-containing fuel, residual and waste materials are being gasified, the refractory protective layer 6 initially represents the inner boundary with respect to the reaction chamber 1. On account of the cooling provided via the cooling channels 5, the slag which has been liquefied in the reaction chamber 1 is also cooled and solidifies, as caked slag 9, on the surface of the protective layer 6. This caked slag 9 becomes responsible for the thermal insulation between the reaction chamber 1 and the cooling channels 5. If ash-free or low-ash fuel materials are being gasified, this caked slag 9 cannot form or be regenerated. In these cases, a lining of refractory brickwork 10 is provided. The cooling channels 5 shown in FIGS. 3 and 4 comprise webs 13 which are welded at right angles onto the pressure shell 4 and are closed off by semicircular or arced bridge pieces 14.

Referring to FIG. 3, the channel members 30 are circularly spaced one from another so that a space 36 is left between each pair of channel members 30. This space is invested and filled by protective refractory layer 6. Anchor ties 12 also are fixedly connected to the inner side 28 of the shell 4 in addition to those connected to the channel members 30. The anchor ties 12 are embedded in the protective refractory layer 6, and provide retentive support of that layer in the shell 4. FIG. 4, shows that the channel members 30 are in longitudinal side-by-side abutment and no spaces exist therebetween. The protective refractory layer 6 is in heat conductive contact only with the channel members.

The invention provides a cooling method for cooling the reactor vessel which involves supplying coolant at a pressure greater than a gasification operating pressure in the reactor space and supplying the coolant through conduits which intervene or pass between the shell inner side and a protective refractory layer covering the conduits. In this manner, the pressurized coolant flows in a flow course wherein no pressure can be transmitted therefrom to the refractory layer. The coolant pressure acts only on the shell, and that structure is designed to withstand high pressures. The shell also readily withstands any differences in pressure between that in the reaction space of the reactor and outside ambient atmosphere pressure.

The invention is not limited by the embodiments described above which are presented as examples only but can be modified in various ways within the scope of protection defined by the appended patent claims.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A gasification reactor vessel comprising:

a pressure shell, said pressure shell having an elongated encircling body wall and shell ends at each of opposite ends of said body wall;

a plurality of channel members defining cooling conduits, each of said channel members extending lengthwise between said shell ends and being distributed circularly around an inner side of said body wall, said channel members being fixedly connected to said inner side, interior spaces of said cooling conduits being in communication with said channel members and said body wall inner side;

a fluid supply conduit communicating with common ends of said cooling conduits for supplying a coolant to said cooling conduits;

a fluid discharge conduit communicating with opposite ends of cooling conduits for outletting heated coolant from said cooling conduits;

a layer of thermally protective material contactingly covering said cooling conduits; and anchor ties fixedly connected to said channel members and embedded in said protective material covering.

2. A gasification reactor vessel according to claim 1, wherein said thermally protective material covering is a refractory material.

3. A gasification reactor vessel according to claim 2, wherein each channel member comprises a pair of spaced webs fixedly connected at common ends of each to said body wall inner side, and a bridging piece joining opposite ends of said webs.

4. A gasification reactor vessel according to claim 3, wherein said channel members are fixedly connected to said body wall inner side at circularly spaced locations thereon.

5. A gasification reactor vessel according to claim 4, wherein said refractory material layer fills spaces between adjacent cooling conduits and covers said body wall inner side between said adjacent cooling conduits.

6. A gasification reactor vessel according to claim 5, wherein anchor ties are fixedly connected to said body wall inner side in the spaces between adjacent cooling conduits and are embedded in the refractory material layer filling said spaces.

7. A gasification reactor vessel according to claim 4, wherein said channel members are fixedly connected to the body wall inner side with gastight and watertight connections.

8. A gasification reactor vessel according to claim 3, wherein the channel members extend around the inner side of said body wall with the webs of each fixedly connected to a web of adjacent cooling conduits.

9. A gasification reactor vessel according to claim 8, wherein said channel members are fixedly connected to the body wall inner side and to each other with gastight and watertight connections.

10. A gasification reactor vessel according to claim 3, further comprising a refractory lining covering said refractory layer.

11. A gasification reactor vessel according to claim 10, wherein said refractory lining comprises a brickwork lining.

12. A gasification reactor vessel according to claim 1, wherein a cross section of said cooling conduits is one of an oval, a semicircle and a polygon.

13. A gasification reactor vessel according to claim 1, further comprising a caked slag layer covering said thermally protective material layer.

14. A gasification reactor vessel according to claim 1, wherein said cooling conduits are sufficiently dimensioned such that pressure in said pressure conduits is maintained when said reactor vessel is depressurize to atmospheric pressure.

15. A gasification reactor vessel according to claim 1, wherein said channel members are arranged for maintaining a pressure higher than operating pressure in the reaction chamber.

16. A gasification reactor vessel comprising:

a cylindrical pressure shell;

a plurality of channel members extending lengthwise of said pressure shell in a circular array around an inner side of said pressure shell, said channel members being fixedly connected to said inner side to provide a corresponding plurality of closed coolant flow courses, each of said closed coolant flow courses being defined by a corresponding one of said channel members and said inner side of said cylindrical pressure shell;

an encircling protective layer of refractory material covering said channel members and being in heat conductive with said channel members; and an encircling lining of at least one of a caked slag and a refractory covering said protective layer.

17. A gasification reactor vessel according to claim 16, wherein the channel members are connected to said inner side of said pressure shell with gastight and watertight welded connections.

* * * * *